United States Patent [19]

Marks

[11] 4,140,141

[45] Feb. 20, 1979

[54] FOLDABLE FRAME APPARATUS

[76] Inventor: Lloyd A. Marks, 2696 Elm Dr., North Bellmore, N.Y. 11710

[21] Appl. No.: 835,887

[22] Filed: Sep. 23, 1977

[51] Int. Cl.[2] ..... A45F 1/16; A45F 1/18

[52] U.S. Cl. ..... 135/4 R; 16/DIG. 13; 135/3 E; 135/DIG. 9

[58] Field of Search ..... 135/4 R, 3 E, DIG. 9; 16/DIG. 13

[56] References Cited

U.S. PATENT DOCUMENTS

| | | | |
|---|---|---|---|
| 414,976 | 11/1889 | Harvey | 135/4 R |
| 1,650,323 | 11/1927 | Byars | 135/4 R |
| 1,846,496 | 2/1932 | Mills | 135/4 R |
| 2,311,515 | 2/1943 | Bridge | 135/4 R |
| 2,473,076 | 6/1949 | Scheibner | 135/4 R X |
| 3,133,549 | 5/1964 | Severing | 135/4 R |
| 3,925,943 | 12/1975 | Petrie | 135/4 R X |

*Primary Examiner*—Ernest R. Purser
*Assistant Examiner*—Conrad L. Berman
*Attorney, Agent, or Firm*—Wigman & Cohen

[57] ABSTRACT

A portable collapsible frame structure for tents, shelters, temporary buildings and the like is disclosed. The frame includes a plurality of elongate, rigid frame members connected by pivotable joints to each other in end-to-end relation such that alternating joints are articulatable in opposite directions to permit folding of the frame members into side-by-side, parallel relation for ease of transportation. The frame structure is held in its erected position by tensile elements which are arranged to apply a compressive force to the abutting ends of the frame members and thereby rigidify the joints of the frame structure.

13 Claims, 9 Drawing Figures

FIG. 4A
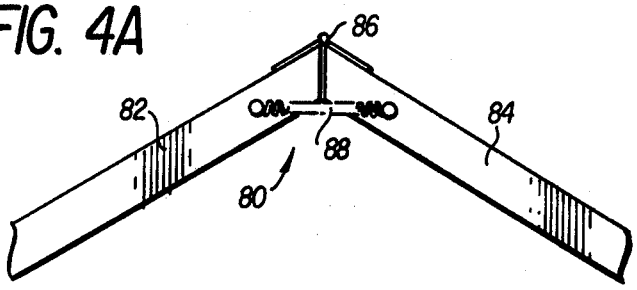
FIG. 4B
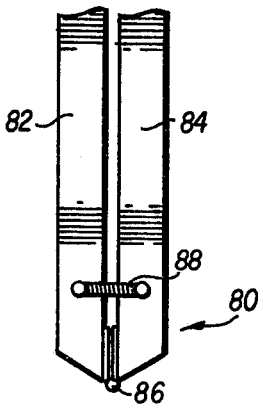
FIG. 5A
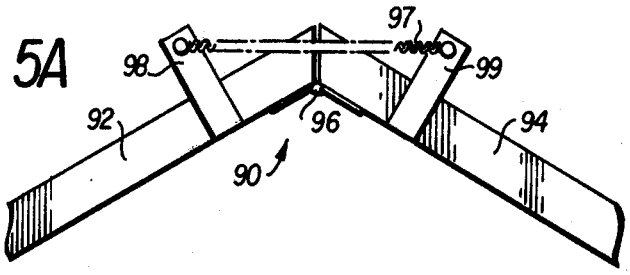
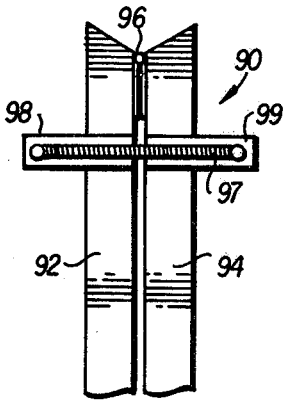
FIG. 5B
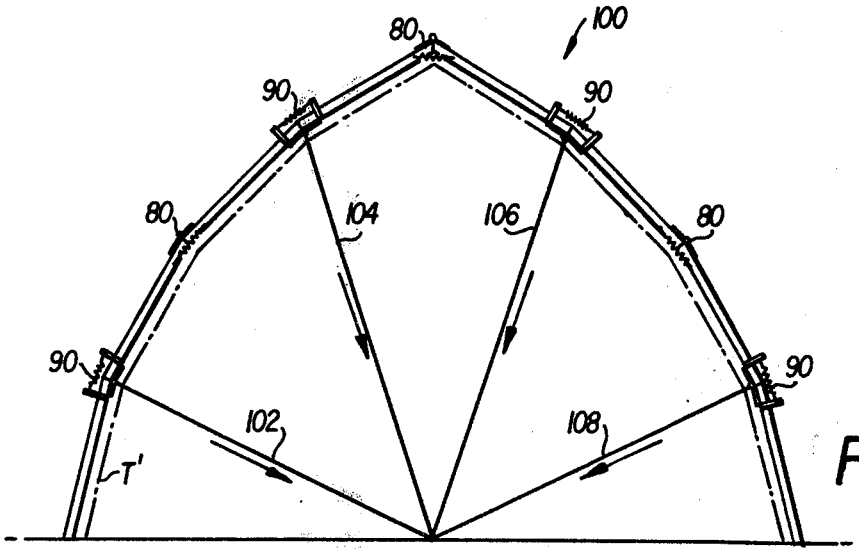
FIG. 6

FOLDABLE FRAME APPARATUS

BACKGROUND OF THE INVENTION

The present invention relates to collapsible structures and more particularly to a portable and foldable frame structure for tents, shelters, temporary buildings and the like.

A search of the prior art failed to uncover any prior art references which disclose the foldable frame structure of the present invention. A number of prior art patents were uncovered which disclose a variety of foldable frames for tent-like structures, knock-down buildings and other collapsible enclosures. The following is a listing of the prior art patents uncovered during the aforementioned search:

U.S. Pat. No. 1,488,772
U.S. Pat. No. 1,504,889
U.S. Pat. No. 1,772,646
U.S. Pat. No. 1,969,260
U.S. Pat. No. 2,185,588
U.S. Pat. No. 2,311,515
U.S. Pat. No. 2,548,758
U.S. Pat. No. 2,642,162
U.S. Pat. No. 2,733,482
U.S. Pat. No. 3,133,549
U.S. Pat. No. 3,206,897
U.S. Pat. No. 3,826,270
U.S. Pat. No. 3,838,703

Typical of the prior art collapsible frames for tentlike or canopy structures, are the foldable frames disclosed, for example, in the above-listed U.S. Pat. Nos. 1,504,889; 1,772,646; 2,185,588; and 3,826,270. These foldable frames comprise a plurality of rigid, elongate members connected together by means of pivot or hinge joints for limited angular articulation. When erected, the joints connecting adjacent members are rigidly locked against pivotable movement to form a substantially rigid, tent-supporting frame. To collapse the frame, the joint locking devices are released and the members are pivoted about the joints to a folded condition for transportation and/or storage.

A number of these known foldable frames, including, for example, those of the aforementioned U.S. Pat. Nos. 2,185,588; 3,133,549; and 3,826,270 are provided with rigid elongate members connected by hinge joints, successive of ones which are articulatable or foldable in opposite directions so that the elongate members will lie against one another in substantially parallel, side-by-side relation when the frame is in its collapsed condition.

Other examples of prior art foldable structures are typified by the collapsible shelters or buildings disclosed in U.S. Pat. Nos. 2,642,162 and 2,733,482. These arch-like structures are constructed of elongate slats or planks arranged in side-by-side relation and which are pivotally connected together along their adjacent lengthwise edges. The pivotable connecting joints between the slats are arranged so that, during erection of the structure, all joints are essentially articulated in the same direction. These structures are maintained erect by means of a tension element connected between the outermost or lowermost slats.

One of the primary drawbacks of the aforementioned prior art foldable frame devices is their relative design complexity, unreliability and expense, associated particularly with the joint structure, joint locking devices, braces and other components necessary to maintain the frame in a rigid, erected condition. Such complex joint components are often subject to breakage or other operational malfunction which renders the entire frame either wholly inoperative or only marginally operative for its intended purpose. Another disadvantage of many of the prior art foldable frames is that, even when folded, such frames occupy a substantial storage volume and are often cumbersome and difficult to handle and erect.

SUMMARY AND OBJECTS OF THE INVENTION

In view of the foregoing limitations and shortcomings of the prior art devices, as well as other disadvantages not specifically mentioned above, it should be apparent that there still exists a need in the art for a foldable frame for collapsible structures which is characterized by the combined advantages of a simple and lightweight design and economical construction and, furthermore, which is designed to facilitate erection of the structure into a substantially rigid supporting frame, as well as to provide a compact folded package for ease of transportation and storage. It is, therefore, a primary objective of this invention to fulfill this need by providing a compactly foldable frame comprised of pivotally connected elongate members which are constructed and arranged to be erected and maintained in a rigid condition by unique joint-rigidifying means.

More particularly, it is an object of this invention to provide a foldable frame structure which includes a plurality of elongate members connected in end-to-end relation by pivotable joints such that successive joints are articulatable in opposite directions to permit folding of the members into side-by-side, substantially parallel relation and which joints are articulatable from their folded condition into an erected condition and rigidified by a tension element applied to one or more of the joints to place the abutting ends of the members in compression.

It is another object of this invention to provide a foldable frame for supporting flexible or semi-flexible enclosures, such as tents and the like, which frame is sufficiently compact and lightweight for "backpack" transporting and which is rapidly and easily erected by a single individual.

Yet another object of this invention is to provide a self-rigidifying foldable frame comprising elongate members connected in end-to-end relation by pivotable joints, each having a resilient joint rigidifying means which is substantially flaccid when the frame is in its folded condition and, when the frame is erected, is placed under tension to rigidify the joint associated therewith.

It is another object of this invention to provide a foldable structure which is adapted to be erected into a rigid support frame without the need for rigid joint locks, braces or other rigid joint locking devices.

Still another object of this invention is to provide a foldable frame wherein external forces, such as wind, tend to further rigidify the frame and thereby inhibit collapse thereof.

Briefly described, the aforementioned objects are accomplished according to the invention by providing a plurality, preferably at least four and, preferably, an even-number, of elongate members, which are articulatingly connected in end-to-end relation by pivotable joints, such as hinges. Each joint and the associated abutting ends of adjacent members are arranged to permit relative angular articulation of the members in a first pivotable direction to a folded, side-by-side relationship. When pivoted in the opposite or second pivotable direction, either the abutting end faces of the elongated members or the hinge-joint construction limits relative angular articulation between the adjacent members so that, at their limit of articulation, the longitudinal axes of the members are oriented at a predetermined angle relative to one another, such angle being determined depending on the desired erected shape of the frame. The pivoting of each joint in the first direction is opposite, in a rotational sense, to the first direction of pivoting of the next adjacent joints of the frame. Thus, when all joints are pivoted in the first pivotable direction, the elongate members are all arranged in side-by-side, parallel relation to form a compact folded package which can be readily stored and transported. To erect the frame and maintain the same in a rigid condition, the joints are all pivoted in the second direction and a rigidifying force is applied to a selected one or ones of the joints, depending, in some embodiments, on the number of members. The rigidifying force, according to the invention, may be applied with various means, again depending on the number of members as well as the pivotal arrangement of the joints as more fully described hereinbelow. In one embodiment of the invention, one or more of the joints is urged toward its second pivoting direction by a rigidifying tensile member, preferably, a somewhat longitudinally resilient member, which is connected at one end to the joint and at the other end to the support surface upon which the frame bears, in the case of a tent, for example, to the ground by a stake or the like. In other embodiments, a rigidifying tensile member is connected between a pair of joints and, in still other embodiments, each joint is provided with a resilient rigidifying element independent of the other joints. These last-mentioned embodiments constitute foldable frames which are termed herein as self-rigidifying frames and which are particularly suited for frames having an odd number or a large number of elongate members.

In some embodiments described herein, the outermost members, i.e., those members located at the opposite ends of the frame, and their pivotable joints to the next adjacent member are prevented from articulation and are rigidified, when the frame is erected, by the combined effort of a tensile force applied to one or more of the other joints and a restraining effect of the enclosure which the frame supports.

The joints between the members may comprise any suitable and conventional hinge or pivotable connection. However, a particularly advantageous construction of the frame joints of the invention involves molding the entire frame, that is, both the elongate frame members and the pivotable joints, as a one-piece, unitary element from a synthetic plastic material. The pivotable joints are thus formed as plastic hinges, otherwise known as the so-called "living" hinges.

With these and other objects, advantages and features of the invention that may become hereinafter apparent, the nature of the invention may be more clearly understood by reference to the following detailed description of the invention, the appended claims and to the several views illustrated in the attached drawings, wherein:

BRIEF DESCRIPTION OF THE DRAWINGS

FIGS. 4A and 4B are fragmentary side views of adjacent members and their self-rigidifying joints showing the same in their respective erected and folded conditions;

FIGS. 5A and 5B are fragmentary side views similar to FIGS. 4A and 4B;

FIG. 6 is an end view showing another alternate embodiment of the frame of the invention employing eight elongate members and a tensile member arranged at alternate joints.

DETAILED DESCRIPTION OF A PREFERRED EMBODIMENT

Figure 1:
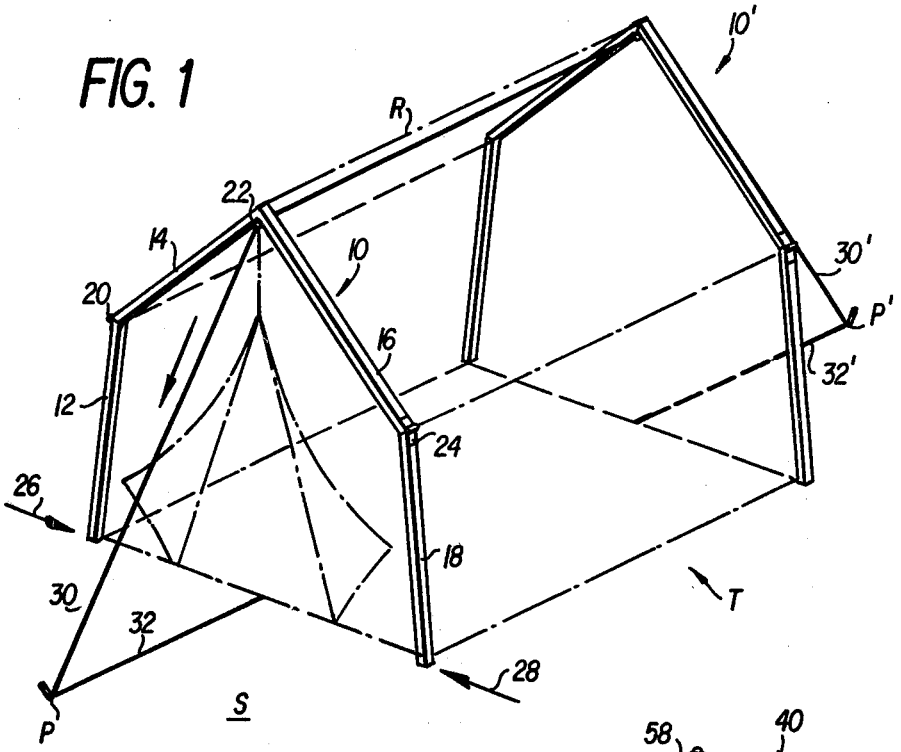
FIG. 1 is a perspective view of one embodiment of the invention showing a pair of foldable frame structures arranged at opposite ends of a tent-like enclosure.

Referring now in detail to the drawings, there is illustrated in FIG. 1 a tent enclosure T shown in phantom lines and employing two foldable frames of the invention which are designated generally by reference numerals 10 and 10', respectively. Since the frames 10 and 10' are substantially identical, only one will be described in detail herein; however, it should be understood that the principles of the invention are equally applicable to various types of collapsible structures whether the same employ only a single frame or a plurality of frames.

Frame 10 comprises four elongate, rigid frame members 12, 14, 16, 18 which are articulatingly connected to each other by pivotable connecting means, such as hinges 20, 22, 24. The frame 10 is preferably arranged inside the tent enclosure T for reasons explained more fully hereinbelow, however, it could also be arranged exterior of the tent T.

The hinges 20 and 24 are arranged toward the outside of the frame as seen in FIG. 1 and pivotably connect the frame members 12, 14 and 16, 18, respectively, so that when the ends of the outermost frame members 12, 18 are urged inwardly by forces designated by the arrows 26, 28, the abutting end faces of the members 12, 14 at hinge 20 and of the members 16, 18 at hinge 24 engage and form limiting stops beyond which the said members cannot be articulated. Assuming that the ends of members 14 and 16 at the location of hinge 22 are fixed, the forces 26, 28 will place the abutting end faces of the members 12, 14 and 16, 18 in compression and thereby rigidify these joints. Hinge 22, located between members 14, 16, is arranged on the inner sside of the frame, that is, on the side of the frame opposite the hinges 20 and 24, so that the abutting end faces of the members 14, 16 form limiting stops when the members are pivoted toward the outside, i.e., upwardly as viewed in FIG. 1. To provide the necessary force for placing the abutting end faces of frame members 14, 16 in compression, a tensile member 30 is connected between the hinge 22 and a fixed point P on surface S upon which the tent T rests. As illustrated in FIG. 1, fixed point P may comprise a tent stake or any other suitable anchoring device.

If desired, the tension element 30 may also extend across the ridge R of the tent T to the corresponding hinge of frame 10' and thence to a fixed point P' to constitute the tensile member 30' for the frame 10'. This is not, however, necessary, since the fabric of the ridge R of the tent prevents outward collapse of the frames 10, 10' and effectively balances the tensile forces in the members 30, 30'.

Tensile member 30 may be either resilient or substantially non-resilient along its longitudinal axis and when tensioned between hinge 22 and point P rigidifies the joint at hinge 22 as well as the joints at hinges 20 and 24 by urging the abutting end faces of all the members 12–18 in compression. Moreover, the tensile member 30 causes the lowermost ends of members 12 and 18 to bear with substantial force against the support surface S, thus rigidifying the entire frame without the need for further joint locking elements. Wind forces which are directed upon the tent surfaces tend to increase the tensile force in members 30, 30' and thereby minimize the risk of collapse of the tent.

With a resilient tensile member 30 affixed at point P, it will be appreciated by those skilled in the art that erection of the frame can be readily accomplished by resting the lowermost free ends of the members 12 and 18 of the frame on the surface S with the members 12 and 18 generally parallel to the surface S and with the frame arranged substantially in a vertical plane. Thereafter, the members 12 and 18 are rotated outwardly, that is, away from each other, thus elevating the joint at hinge 22 and applying tension to the member 30. When the members 12 and 18 are approximately longitudinally aligned with the members 14 and 16 respectively, the tensile force in member 30 will cause the hinge joints 20 and 24 to "snap" outwardly and the hinge joint 22 to "snap" downwardly thereby placing all the abutting end faces of the joints in compression and rigidifying the frame in its erected position. Collapsing of the frame is accomplished in the reverse order of steps described above.

If a substantially non-resilient tensile member is utilized, the anchoring elements at points P and P' are preferably affixed after erection of the frames 10 and 10' and the tensile members are preferably provided with conventional length-adjusting means. Using a non-resilient tensile member, folding of the frame is accomplished by releasing tension from the member 30. The frame members may then be readily pivoted to position them in side-by-side relation, that is, with the outer surfaces of members 16, 18 and of members 12, 14 and the inner surfaces of members 14, 16 in confronting, substantially parallel relation. The frames may either be removed from the tent and folded or retained with the tent, folded and rolled-up with the tent fabric to form a compact bundle.

The frames 10, 10' are preferably situated interiorly of the tent T for several important reasons. Particularly in the case of tents with attached floors, the resistance of the tent fabric itself may be employed to limit outward articulation of the free ends of members 12 and 18, in effect, providing the forces indicated by arrows 26, 28 in FIG. 1. Thus, collapse of the tent caused, for example, by an inadvertent outward articulation or blow to either member 12 or 18, is avoided. In addition, the interiorly disposed frame may be more readily adapted for use on hard support surfaces, such as tent platforms, concrete foundations and the like. Use of the frame inside the tent rather than outside also eliminates the need to provide means on the inside of the frame or on the tent exterior for fastening the tent to the frame. If desired, however, the tent may be fastened, either permanently or removably, to the frame at the hinge joints and/or frame members and the frame members folded with the tent remaining attached thereto. For example, the end walls of the tent may be provided with fabric sleeves in which the frame members are removably inserted or permanently affixed.

To facilitate location of the anchoring points P, P' of the tensile members 30, 30', placement tapes 32, 32' may be provided for locating the anchoring devices in their optimum positions for a particular frame and tent combination. It will be appreciated by those skilled in the art that the inclination of the tensile members may vary from one tent-and-frame combination to another and, in fact, may be arranged perpendicularly of the support surface in certain configurations. For example, with a pair of four-member frames arranged orthogonally of each other, or even with three or more frames arranged at an appropriate angular spacing between them, and with a common hinge mechanism at the uppermost intersection of the frames, a single, vertically-oriented tensile member may be used to maintain both or all frames in a rigid, erected condition.

The frame members 12–18 may be metallic elements or non-metallic elements, i.e., plastic, wood, etc.; they may be tubular or solid, (substantially rigid or somewhat flexible,) and may have numerous cross-sectional shapes and areas depending on the particular size and shape of the enclosure for which the frame is intended to support. The hinge joints 20–24 may be incorporated integrally with the ends of the frame members or as separate hinges as shown in FIG. 1.

Figure 2:
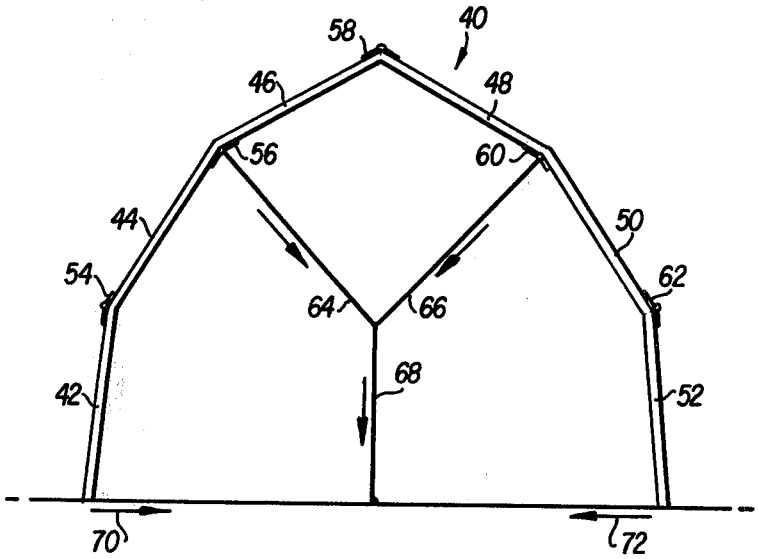
FIG. 2 is an end view of an alternate embodiment of the frame of the invention in its erected condition and employing a different number of elongate members than the embodiment of FIG. 1.

Referring now to FIG. 2, there is shown an alternate embodiment of the foldable frame of the invention which is designated generally by reference numeral 40. Frame 40 includes elongate members 42–52 pivotally connected at their adjacently-situated ends by hinges 54–62 in a manner similar to that shown and described in connection with the frame 10 of FIG. 1, the primary differences being in the number of frame members and the location of the tensile members for maintaining the hinge joints rigid. In this embodiment, a pair of tensile members 64, 66 are connected to hinge joints 56, 60, respectively, and terminate at a single tensile member 68, which, in turn, is anchored to a support surface. Alternatively, the tensile members 64, 66 may themselves be directly anchored to the support surface. From the above discussion, it will be apparent that the forces applied to the hinge joints 56, 60 by the tensile members 64, 66, 68 have force components which urge the abutting end faces of all the frame members 42–52 in compression and thereby act to rigidify the frame. With resilient tensile members, erection of the frame can be accomplished in a manner similar to the "snap" action described above in connection with the frame 10 of FIG. 1. Inwardly directed forces, designated by the arrows 70, 72, at the outermost ends of members 42 and 52 are provided, for example, by the interaction between such outermost members and the tent fabric itself which serves in the same manner as in FIG. 1 to prevent outward articulation of these outermost members.

As with the embodiment of FIG. 1, two or more of the six-member frames of FIG. 2 may be arranged at appropriate angular spacings relative to each other with a common hinge mechanism at the uppermost intersection of the frames. In this case, a horizontally-arranged resilient tensile member is connected between the successive joints located about the frames in the plane of hinge joints 56 and 60. Further tensile members are connected to each hinge in the plane of the hinges 54, 62 and are appropriately anchored to the supporting surface, however, in lieu of further tensile members, each of the hinge joints in the plane of joints 56 and 60 may be provided with a joint rigidifying means such as that described hereinafter in connection with FIG. 5A.

Figure 3:
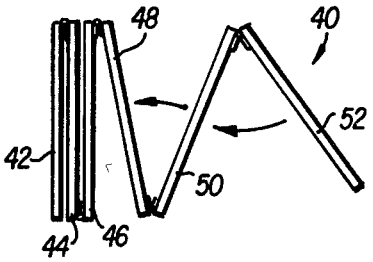
FIG. 3 is an elevation view of the frame of the invention, depicting the manner in which it may be folded into a compact package.

FIG. 3 illustrates the simple manner in which the successive hinge joints of the frame members 42–52 are pivoted in opposite directions to enable folding of the frame into a compact package of relatively small dimensions.

The principles of the invention are also manifested in the embodiments shown in FIGS. 4–7 wherein each pivotable joint of the frame is provided with a resilient member for rigidifying the joint when the frame members are pivoted to their erected positions. These embodiments are characterized herein as self-rigidifying foldable frames and can be advantageously used when an odd number or a large number of frame members is desired or dictated by the shape of the supported enclosure.

FIGS. 4A and 4B show one joint 80 of the self-rigidifying frame in its erected and folded positions, respectively. Frame members 82 and 84 are connected at their abutting ends by a hinge 86. A resilient element 88, shown as a coil spring in the drawings, is affixed at its ends to a respective one of the members 82, 84. The length and spring constant of resilient element 88 is selected so that, in the erected condition of the joint 80 shown in FIG. 4A, a substantial force is applied to the joint to maintain the abutting end faces of the members in compression, thereby rigidifying the joint. To fold the frame, the frame members 82, 84 are articulated to the position shown in FIG. 4B so that the resilient element is substantially flaccid, i.e., relaxed. It will be apparent that in articulating the joint 80 from the FIG. 4B position to that of FIG. 4A, there results a kind of "snapping" action as the longitudinal axis of the resilient element 88 passes the pivot axis of the hinge 86, thereby causing the aforementioned self-rigidifying effect.

If desired, means may be provided for increasing or decreasing the tension in the resilient element 88. This may be accomplished by suitable means for lengthening or shortening the relaxed length of the resilient elements between their connecting points on the frame members or means for increasing or decreasing the spacing between such connecting points.

FIGS. 5A and 5B show a joint 90 connecting frame members 92, 94 by means of a hinge 96 arranged, in this case, on the underside of the frame members 92, 94 as viewed in FIG. 5A. Frame members 92, 94 are held in their erected position, i.e., rigidified, by means of a resilient element 97 connected to extensions 98, 99 secured to or formed with a respective frame member. The extensions 98, 99 of alternate joints 90 may be located at different spacings from their associated hinges or arranged on opposite sides of the frame to avoid interference with each other when in the folded position.

FIG. 6 shows an eight-member self-rigidifying frame 100 constructed with alternating joints 80 and 90. In this embodiment, it is advantageous to support the tent enclosure T' shown in phantom lines with the frame 100 arranged exteriorly of the tent T'. This may be accomplished in any expedient way, for example, by tie tapes permanently secured to the tent T' at the locations of the frame joints and which are tied to the frame at each joint either before or after erection of the frame. Tension elements shown as lines 102–108 in FIG. 6 illustrate an alternate arrangement for rigidifying the eight-member frame 100 in lieu of the joints 80, 90, in other words, in a manner similar to that of FIGS. 1 and 2. In addition, it will be apparent that various combinations of the joints 80, 90 and tensile members may be employed according to the principles of the invention as described above. It is important to note that the stability of the self-rigidifying joint of the invention, i.e., the force tending to maintain the joint in its erected condition, is dependent, not only upon the length and spring constant of the resilient element, but also upon the length of the moment arm between the pivot axis of the joint and the longitudinal axis of the resilient element, the greater the moment arm, the greater the potential stability.

Figure 7:
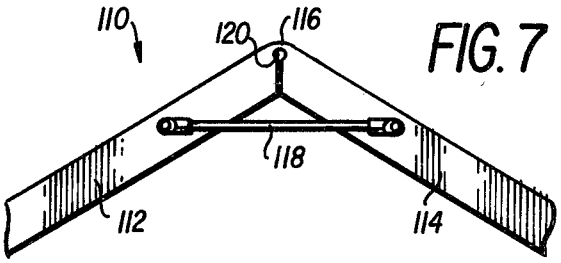
FIG. 7 is a fragmentary side view illustrating another embodiment of the hinge and frame structure of the invention.

FIG. 7 illustrates a particularly advantageous arrangement of a self-rigidifying joint 110 of the foldable frame of the invention. In this embodiment, the frame members 112, 114 and the hinge 116 are integrally formed of a synthetic plastic material by a known and, therefore, not particularly described process. The hinge 116 comprises a so-called "living" hinge formed of the material of and integrally with the frame members and, thus, the entire frame may be molded in one piece. A resilient element 118 is connected to the frame members 112, 114 and the joint 110 functions in the same manner as the joint 80 of FIG. 4A. (The joints adjacent joint 110 would be arranged to articulate as joint 90 of FIG. 4B) It will also be appreciated that such a one-piece, unitary frame could be erected and rigidified by means of a tensile member similar to the member 30 of FIG. 1 by securing the same through the opening formed between the hinge and the abutting end faces of the frame members forming a joint similar to joint 22 of FIG. 1.

While the resilient elements of the foldable frames described above have been illustrated as coil springs, any suitable equivalents may be used, such as, for example, resilient shock cord, so-called "bungee" cord and the like. In addition, the shape and size of the foldable frames of the invention described above may be varied greatly by varying the length and number of the frame members as well as the angles at which the abutting end faces of the members are formed.

Although only preferred embodiments are specifically illustrated and described herein, it will be appreciated that many modifications and variations of the present invention are possible in light of the above teachings and within the purview of the appended claims without departing from the spirit and intended scope of the invention.

What I claim is:

1. A foldable support frame having erected and folded positions, said frame comprising a plurality of elongated members arranged in substantially end-to-end relation in a generally inverted U-shaped configuration when in said erected position, said members including two outermost members defining spaced opposite ends of said frame, means pivotally connecting adjacent ends of said members and defining angularly articulatable joints therebetween, said members having abutting end faces for limiting the angular articulation of said joints, said pivotally connecting means and abutting end faces being constructed and arranged such that each joint is angularly articulatable in a direction opposite to the direction of articulation of a next adjacent joint such that said members are adapted to lie in substantially side-by-side relation when said frame is in said folded position, said joints comprising alternating inwardly and outwardly articulating joints, means coacting with said two outermost members for limiting outward articulation thereof and tensile means operatively connectd to said frame for urging and maintaining the abutting end faces of all said joints in compression when said frame is in its erected position, said tensile means comprising a longitudinally extensible tensile member having an elastically elongated length and a relaxed length substantially less than said elongated length, said tensile member having two ends, a first one of which is connected to at least one of said outwardly articulating joints and a second one of which is adapted to be connected at an anchoring point such that, during erection of said frame from the folded position thereof, said tensile member initially elastically resists articulation of said joints toward their erected positions and subsequently elastically urges said joints toward their erected positions, whereby said joints are snapped to a position in which all the abutting end faces of the joints are in compression.

2. A support frame according to claim 1, wherein said tensile mean comprises the sole means for urging the abutting end faces of said one joint in compression.

3. A support frame according to claim 1, wherein said frame comprises six elongated members and five joints, said tensile member being connected to the joints adjacent the central one of said joints.

4. A support frame according to claim 1, wherein said frame comprises four elongated members and three joints, said tensile member being connected to the central one of said joints.

5. A support frame according to claim 1, wherein said elongated members and said joints are integrally formed in one piece of a synthetic plastic material.

6. A support frame according to claim 1, wherein said elongated members and said joints are integrally formed in one piece of a synthetic plastic material.

7. A support frame according to claim 1, wherein said frame is erected on a support surface, said anchoring point being located at said support surface.

8. A support frame according to claim 1, including a cover supported by said frame, said means limiting outward articulation of said two outermost members comprising a portion of said cover.

9. A support frame according to claim 8, wherein said frame is arranged interiorly of said cover.

10. A foldable support frame having erected and folded positions, said frame comprising a plurality of elongated members arranged in substantially end-to-end relation in a generally inverted U-shaped configuration when in said erected position, said members including two outermost members defining spaced opposite ends of said frame, means pivotally connecting adjacent ends of said members and defining angularly articulatable joints therebetween, each joint having a pivot axis, said members having abutting end faces for limiting the angular articulation of said joints, said pivotally connecting means and abutting end faces being constructed and arranged such that each joint is angularly articulatable in a direction opposite to the direction of articulation of a next adjacent joint such that said members are adapted to lie in substantially side-by-side relation when said frame is in said folded position, said joints comprising alternating inwardly and outwardly articulating joints, means coacting with said two outermost members for limiting outward articulation thereof and tensile means connected to at least two joints for urging and maintaining the abutting end faces of such joints in compression when said frame is in its erected position, said tensile means comprising longitudinally extensible tensile members each operatively connected between the frame members of an associated joint and spanning said associated joint, the tensile members of the outwardly articulating joints being spaced outwardly of the respective pivot axes thereof, the tensile members of the inwardly articulating joints being spaced inwardly of the respective pivot axes thereof such that said tensile members initially elastically resist articulation of said associated joints toward their erected positions and subsequently elastically urge said associated joints toward their erected positions, whereby said associated joints are snapped to a position in which the abutting end faces thereof are in compression.

11. A support frame according to claim 10, wherein said frame compression six elongated members and five joints, tensile members being connected to each of said joints.

12. A support frame according to claim 10, wherein said frame comprises four elongated members and three joints, tensile members being connected to each of said joints.

13. A support frame according to claim 10, wherein said elongated members and said joints are integrally formed of a synthetic plastic material.

* * * * *